United States Patent [19]

Spring et al.

[11] 4,244,468

[45] Jan. 13, 1981

[54] PACKAGE FOR PHONOGRAPH RECORDS

[76] Inventors: Gerard E. Spring, 37 Libby Rd., Milton, Mass. 02186; Joseph M. Bernardini, 15 Pratt St., Allston, Mass. 01134

[21] Appl. No.: 61,668

[22] Filed: Jul. 30, 1979

[51] Int. Cl.[3] ..... B65D 27/08; B65D 85/02; B65D 85/57

[52] U.S. Cl. ..... 206/312; 206/593; 229/56; 229/72

[58] Field of Search ..... 206/312, 309, 303, 307, 206/313, 593; 229/56, 72; 150/39

[56] References Cited

U.S. PATENT DOCUMENTS

| | | | |
|---|---|---|---|
| 2,003,854 | 6/1935 | Cox | 229/72 |
| 3,077,263 | 2/1963 | Froehlig | 229/72 |
| 3,236,439 | 2/1966 | Johnson et al. | 229/72 |

*Primary Examiner*—William T. Dixson, Jr.
*Attorney, Agent, or Firm*—Morse, Altman, Oates & Dacey

[57] ABSTRACT

A package is provided for phonograph records in which four small-diameter records are packaged in a sleeve having the outside dimensions corresponding to those of a sleeve for a large diameter record. The package is comprised of a sleeve having a cruciform separator mounted between the front and rear panels of the sleeve. The separator defines four pockets, one for each of four small-size records packaged in the sleeve. The sleeve typically is square in outline and the pockets are located in slightly overlapping relation at each corner quadrant of the sleeve, access being had through opposite open side edges of the sleeve.

6 Claims, 13 Drawing Figures

Fig. 6
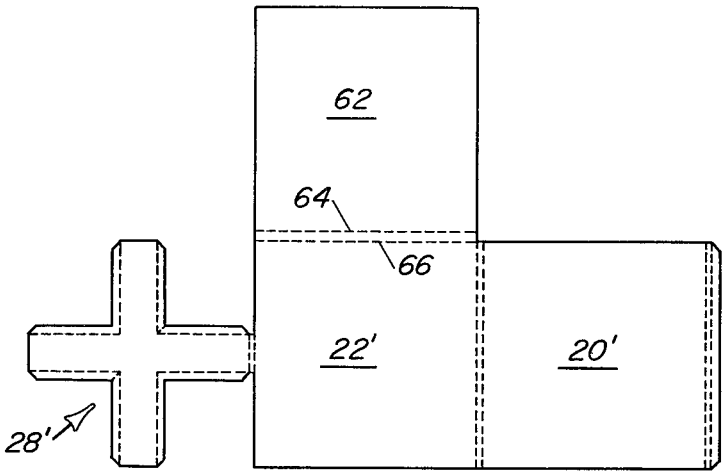
Fig. 7
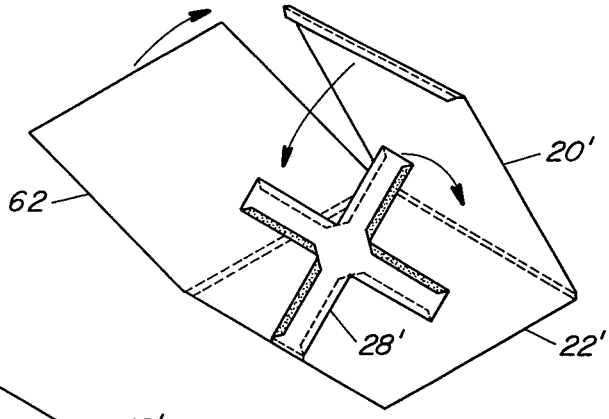
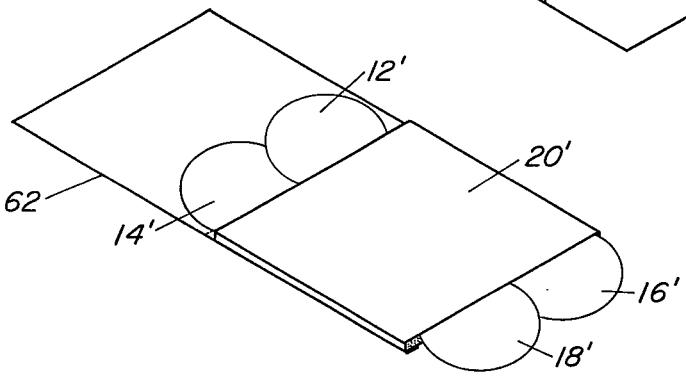
Fig. 8
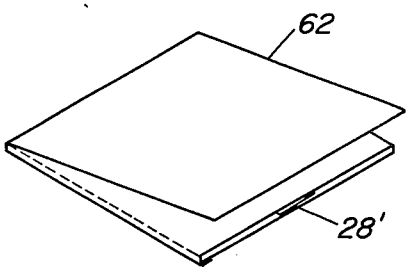
Fig. 9

Fig. 10
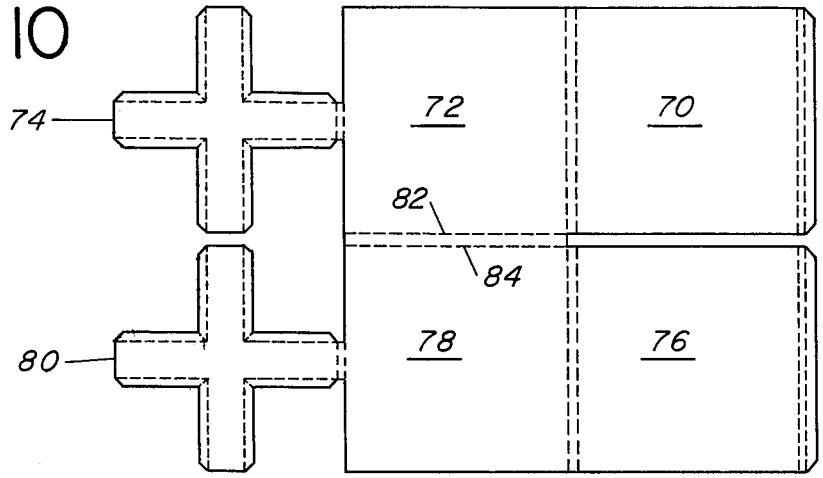
Fig. 11
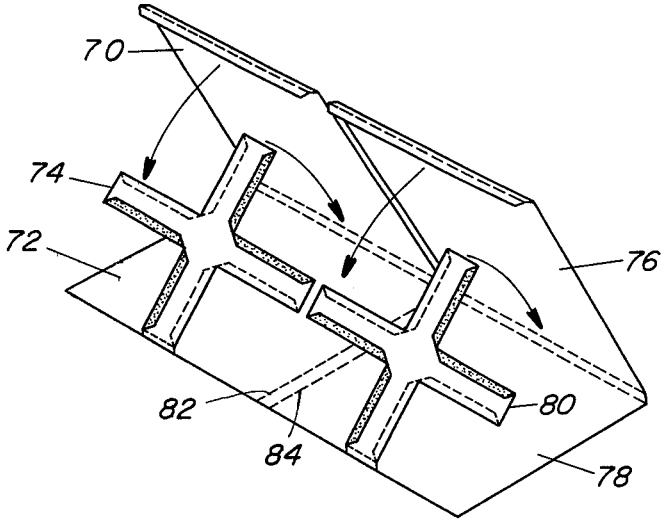
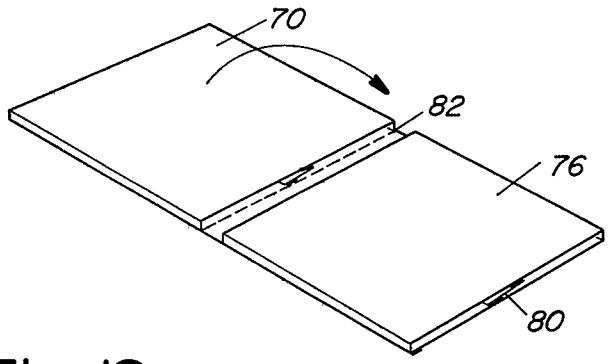
Fig. 12
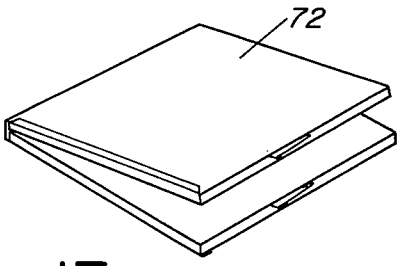
Fig. 13

PACKAGE FOR PHONOGRAPH RECORDS

BACKGROUND OF THE INVENTION

1. Field of the Invention

This invention relates generally to packages and more particularly is directed towards a novel package for vending and storing small-size records such as 7" diameter records in the same size sleeve used to vend and store larger-size records such as 12" records.

2. Description of the Prior Art

In the record industry there are two popular sizes of records sold on the mass market. Most records now being sold are the standard 12" diameter record which is a long playing record used on a conventional turntable and rotated at 33⅓ rotations per minute. Typically, single 12" records are sold in a cardboard sleeve having a paper inner sleeve and a clear plastic outer wrapper. The cardboard sleeves normally are square, measuring perhaps 12½" on each side. Such records typically are sold in bins and arranged in a generally upright position which allows the customer to leaf quickly through the albums in the bin.

There also are available smaller size records which measure 7" in diameter. These are 45 RPM records or extended play records and, while as not popular as the 12" LP records, nevertheless represent a substantial market. Heretofore the small 7" diameter records have been packaged in a single cardboard sleeve or in shallow boxes where several records are sold in a group. Because of the small-size of the 7" records as well as the small-size of the package, such small-size records have presented problems in shipment, retail display and storage. For example, most retail record stores generally are provided with a large number of bins constructed to accommodate only the 12" size records with the result that the smaller size records are piled randomly within an over-size bin or placed in some other unsuitable container. Thus it has been difficult to index and display 7" records in an orderly fashion consistent with the manner in which 12" records are indexed and displayed.

Accordingly, it is an object of the present invention to provide improvements in record packaging. Another object of this invention is to provide a package for 7" diameter records which has exterior dimensions corresponding to those of a package for a 12" record. A further object of this invention is to provide a package for four or more 7" diameter records in a single sleeve having dimensions corresponding to those of a sleeve for a 12" record.

SUMMARY OF THE INVENTION

This invention features a package for phonograph records or the like, comprising a pair of substantially square, superimposed panels joined along two opposing marginal edges to form a sleeve and divider means connected between said panels and defining a plurality of individual pockets within each of four quadrants of said sleeve whereby a plurality of phonograph records may be packaged in said sleeve in slightly overlapping relation.

BRIEF DESCRIPTION OF THE DRAWINGS

FIG. 6 is a plan view similar to FIG. 1 but showing a modification of the invention, FIG. 7 is a view in perspective showing the blank of FIG. 6 in a partially folded condition, FIG. 8 is a view in perspective showing a completed record album from the FIG. 6 blank in open position with records partially in place, FIG. 9 is a view in perspective showing a record album of FIG. 8 in a substantially closed position, FIG. 10 is a view similar to FIG. 1 but showing another modification of the invention, FIG. 11 is a view in perspective showing the FIG. 10 embodiment in a partially folded position, FIG. 12 is a view in perspective showing the completed album of FIG. 10 in an open position, and, FIG. 13 is a view in perspective showing the FIG. 12 album in a substantially closed position.

DETAILED DESCRIPTION OF THE PREFERRED EMBODIMENTS

Figure 1:
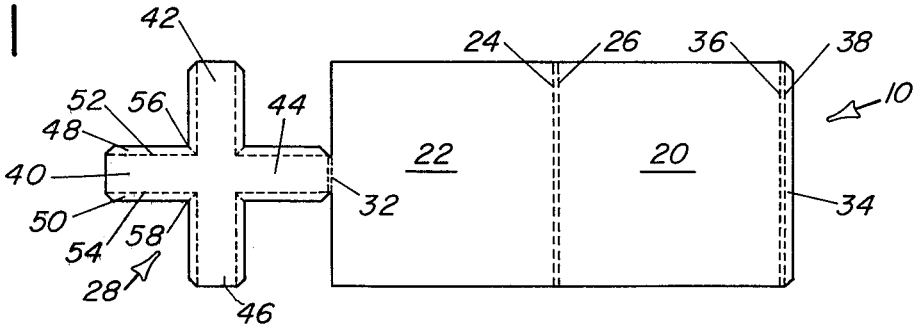
FIG. 1 is a plan view of a blank sheet of material from which a preferred embodiment of a phonograph record album package of invention is made.

Referring now to the drawings and to FIGS. 1 through 5 in particular, the reference character 10 generally indicates a thin, flat and substantially square package adapted to contain four phonograph records 12, 14, 16 and 18. In the preferred embodiment of the invention the exterior dimensions of the package 10 correspond to the exterior dimensions of a cardboard sleeve album used to package a standard 12" diameter LP record. Typically, such albums are 12½" square and are open along one side edge through which the record is inserted and removed from the album. In practice, the record is also covered by a soft paper inner sleeve to provide protection for the record and, normally, a new album will be covered by a removable transparent plastic wrapper.

The package 10 in the preferred embodiment is square in outline, being approximately 12½" in length and width and is adapted to contain four 7" diameter records, as shown. Each record is located in a separate corner quadrant of the sleeve and each record slightly overlaps and adjacent record although not in contact with any record. The sleeve is formed with two side openings to allow two records to be inserted in and withdrawn from opposite ends of the album.

The package 10 is fabricated from a simple blank sheet of material as best shown in FIG. 1. The packaging blank of FIG. 1 typically is made by die cutting techniques well known in the art and is comprised of three main sections, namely, front and rear panels 20 and 22 of generally corresponding size and shape joined by a pair of transverse, slightly spaced, parallel hinge lines 24 and 26 and a cruciform divider or separator 28 joined to the left hand edge of the rear panel 22 by slightly spaced, parallel hinge lines 30 and 32. The front panel is formed with a narrow flap 34 along the outer right hand edge thereof and connects to the front panel by means of fold lines 36 and 38. The flap may be covered with a stratum of adhesive suitable to bond the flap when folded over against an opposing edge of the rear panel 22. Various adhesives may be used for this purpose such as pressure sensitive adhesives, heat-activated adhesives, or other adhesives commonly used in the packaging industry. Preferably, the inner face of the flap 34 is covered with adhesive so as to bond against the outer face of the rear panel 22, as suggested in FIG. 5. In practice, the ends of the flap 34 are beveled to eliminate the possibility of corners of the flap catching on other objects.

Figure 2:
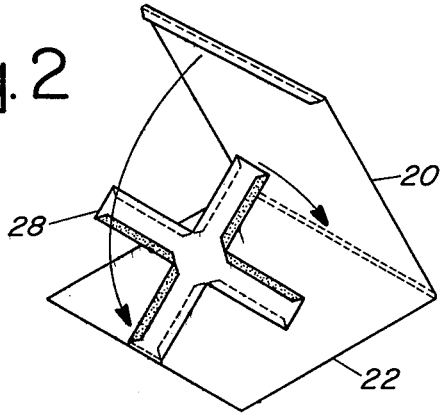
FIG. 2 is a view in perspective showing the FIG. 1 blank partially folded.

The cruciform separator 28 is comprised of four intersecting legs 40, 42, 44 and 46 perpendicular to one another and forming a cross the width and length of which are substantially equal to the width and length of the panel 22, being approximately 12½" in width and 12½" in length. Each leg is approximately 5½" long and approximately 2" wide. Each leg is also provided with a pair of marginal flaps 48 and 50, one along each long edge of each leg and connected to the respective leg by means of fold lines 52 and 54. Each flap is approximately ½" wide and preferably extends the full length of each leg, terminating in the beveled ends at the outer ends thereof and in a diagonal cut 56, 58 at the inner ends thereof. The flaps 48 and 50 are folded against opposite faces of their respective leg when the blank is being set up into its final configuration and each of the flaps is coated on one face with an appropriate adhesive stratum. The coated face of one flap is reverse to the coated face of the flap on the other side of the leg. The coating arrangement is such that the same sides of perpendicularly adjacent pairs of leg flaps are adhesively coated and folded back against their respective legs in alternating sequence as best shown in FIG. 2.

Figure 5:
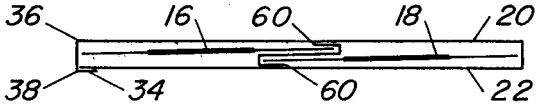
FIG. 5 is a cross-sectional view taken along the line 5—5 of FIG. 4.

In this fashion, with the individual flaps 48 and 50 folded back against their respective legs, the cruciform separator 28 is folded in against the inner face of the panel 22 so that those flaps 48, 50 folded inwardly will bond the separator 28 against the inner face of the panel 22. Likewise, those flaps 48 and 50 folded outwardly will bond the separator to the inner face of the panel 20 when the panel 20 is folded against over the separator 18, as best shown in FIG. 5 forming thereby offset horizontal and vertical channels 60, 60'. In the completed package the end flap 34 is folded over the opposite edge of the panel 22 to bond to it to form a sleeve package open at two opposite edges.

Figure 4:
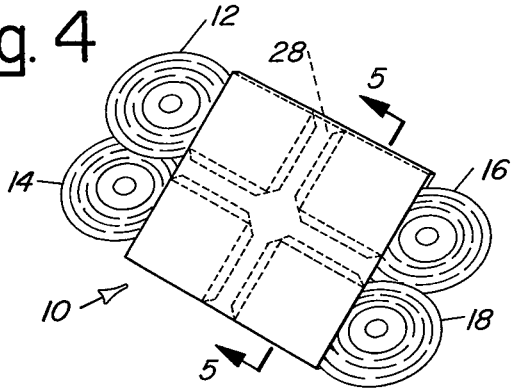
FIG. 4 is a view similar to FIG. 3 but showing individual phonograph records partially in place.
Figure 3:
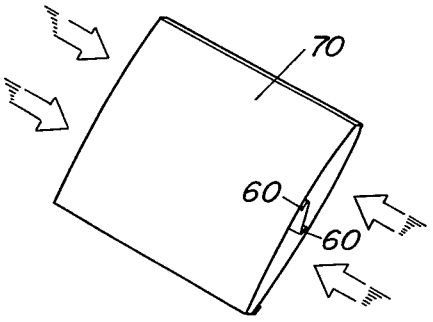
FIG. 3 is a view in perspective of a fully set-up phonograph album.

With the blank fully folded into the package form of FIGS. 3, 4 and 5, four pockets are formed in the package, one in each corner quadrant. Each pocket is formed on one side by a closed edge of the sleeve formed by the folded panels 20 and 22, on another side by a horizontal channel 60 formed by one of the folded separator flaps 48 and 50 bonded to opposite faces of the panels 20 and 22 within the sleeve and at the inner end by a vertical channel 60'. The channels 60, 60' are arranged at right angles to one another and define in each quadrant a pocket substantially 7" square open along the open edges of the sleeve. The channels 60, 60' are on opposite sides of each leg so that each leg defines two channels for portions of two slightly overlapped records as shown in FIGS. 4 and 5. The channels thus form the pockets which hold the four records within the sleeve, one record in each quadrant and adjacent records slightly overlapping one another but separated by means of the cruciform divider which keeps the records out of direct contact thereby preventing scratching, abrasion or the like.

Four 7" records may be neatly packaged in a sleeve of a size substantially equal to that of a sleeve for a 12" record whereby the same shipping, storage and display facilities used for the standard 12" records may be utilized for the 7" records.

Records are inserted in and withdrawn from the sleeve through the two open edges in the manner suggested in FIGS. 3 and 4. The dimensions of the package elements are such as to provide a reasonably snug fit for the records so that they will not accidently slip out. Obviously, the outer faces of the panels 20 and 22 may be suitably illustrated as is customary in the record trade and the entire package may be covered with a removable transparent wrapper as is done with standard 12" records.

Referring now to FIGS. 6 through 9, there is illustrated a modification of the invention and, in this embodiment, a cover panel 62 is connected to the package of the FIG. 1 embodiment. The cover panel 62 joins the upper edge of rear panel 22' along spaced parallel fold lines 64 and 66. The fold lines are spaced more widely apart than other fold lines in order to permit the cover panel 62 to be folded across the front of the completed sleeve in the manner of FIG. 9. The function of the cover panel is to close the left-hand open end of the sleeve and thereby further reduce risk of records accidently slipping out the package. The cover panel may, of course, be printed with whatever illustrations or legends that may be desired.

Referring now to FIGS. 10 through 13 there is illustrated another modification of the invention and, in this embodiment, a double packaging arrangement is provided to produce an album capable of holding eight 7" records in a package having dimensions similar to those of a package for a standard 12" record.

The packaging blank of FIG. 10 is comprised of a pair of matching sections, each section similar to the FIG. 1 embodiment with the upper section comprised of a front panel 70, a rear panel 72 and a cruciform divider 74 hinged to one another in the same manner as in the corresponding portions of the FIG. 1 embodiment. The lower section of the FIG. 10 album is comprised of a front panel 76, a rear panel 78 and a cruciform divider 80 with the upper and lower sections joined to one another by spaced, parallel fold lines 82 and 84 at the junction of panels 72 and 78. The individual upper and lower sections are formed and folded in a manner similar to the principal embodiment with the cruciform dividers 74 and 80 folded over against their respective panels 72 and 78 and bonded thereto. Next, the front panels 70 and 76 are folded against the cruciform dividers 74 and 80 and their flaps sealed against the opposite edge of panels 72 and 78. The package is able to accommodate eight 7" single records, four in each section. The two album sections may then be folded along the fold lines 82 and 84 in the manner suggested in FIGS. 12 and 13 to close the package. Individual records may be inserted or withdrawn from the outer edges of the open sleeve sections or by opening the sections in the position of FIG. 12, records may be withdrawn from the innermost pockets.

While the invention has been described with particular reference to the illustrated embodiments, numerous modifications thereto will appear to those skilled in the art. For example, further protection of the records may be provided by lining the inner walls of the package with a thin stratum of soft material such as a resilient foam plastic. This will not only cushion the records but also aid in retaining the records in place. Also, in place of cruciform separator to position the records in the package, individual record-size sleeves may be used, each sleeve being attached to an inner face of the package with two sleeves along each open end in slightly overlapping relation and with the sleeve openings being located along an open edge of the package. While the package is particularly useful for phonograph records it may also be used for other, similar shaped items.

Having thus described the invention, what we claim and desire to obtain by Letters Patent of the United States is:

1. A package for phonograph records and the like, comprising (a) generally rectangular and substantially coextensive front and rear panels joined to one another along one pair of opposite edges to form a sleeve open along another pair of opposite edges, (b) divider means mounted between said panels and defining a plurality of offset and partially overlapping pockets some pockets open along one open edge of said sleeve and other pockets open along the other open edge of said sleeve, (c) each of said pocket being substantially smaller than said sleeve and dimensioned to contain one of said records.

2. A package according to claim 1 wherein said divider means includes a member formed with medial channels extending between said other pair of opposite edges of said sleeve and with medial stop portions extending between said one pair of opposite edges of said sleeve.

3. A package according to claim 2 wherein said member is in the shape of a cross, said cross being formed with four mutually perpendicular legs, the marginal longitudinal edges of each leg being selectively folded and bonded to the inner faces of said panels to form said channels and stop portions.

4. A package according to claim 3 wherein said panels and said member are formed from a single blank of sheet material and connected to one another by fold lines.

5. A package according to claim 1 including a cover panel hinged along an edge of one of said panels.

6. A package according to claim 1 including separate front and rear panels and divider means similar to and hinged to said first front and rear panels and said first divider means.

* * * * *